US008801488B2

(12) United States Patent
Irmler

(10) Patent No.: US 8,801,488 B2
(45) Date of Patent: Aug. 12, 2014

(54) CHIN STRAP SENSOR FOR TRIGGERING CONTROL OF WALK-AROUND CHARACTERS

(71) Applicant: Disney Enterprises, Inc., Burbank, CA (US)

(72) Inventor: Holger Irmler, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 159 days.

(21) Appl. No.: 13/651,743

(22) Filed: Oct. 15, 2012

(65) Prior Publication Data

US 2014/0106642 A1 Apr. 17, 2014

(51) Int. Cl.
*A63H 13/02* (2006.01)

(52) U.S. Cl.
USPC ..... 446/27; 466/26; 466/175; 2/171; 2/410

(58) Field of Classification Search
USPC ..... 446/26–27, 175
See application file for complete search history.

(56) References Cited

U.S. PATENT DOCUMENTS

| | | | | |
|---|---|---|---|---|
| 4,177,589 | A | 12/1979 | Villa | |
| 4,260,035 | A * | 4/1981 | Loveless et al. | 180/6.5 |
| 4,298,863 | A * | 11/1981 | Natitus et al. | 340/573.1 |
| 4,451,933 | A * | 6/1984 | Seng et al. | 2/202 |
| 4,486,630 | A * | 12/1984 | Fetchko | 200/52 R |
| 4,660,033 | A * | 4/1987 | Brandt | 340/12.5 |
| 5,289,273 | A | 2/1994 | Lang | |
| 5,603,065 | A | 2/1997 | Baneth | |
| 5,845,540 | A * | 12/1998 | Rosheim | 74/490.05 |
| 6,121,953 | A | 9/2000 | Walker | |
| 6,500,041 | B1 | 12/2002 | Crome, Jr. | |
| 6,899,585 | B2 | 5/2005 | Nelson | |
| 7,477,207 | B2 | 1/2009 | Estep | |
| 7,486,798 | B2 | 2/2009 | Anjanappa et al. | |

(Continued)

FOREIGN PATENT DOCUMENTS

| | | |
|---|---|---|
| WO | 9836631 | 8/1998 |
| WO | 2004114107 | 12/2004 |
| WO | 2008025386 | 3/2008 |
| WO | 2011085501 | 7/2011 |

OTHER PUBLICATIONS

Dickson-2010, "Pumpkinhead Mask Proposal" available on line at www.engr.siu.eud/ugrad1/me495a/PUMPKNFC/Final Proposal.doc.

(Continued)

*Primary Examiner* — William Brewster
*Assistant Examiner* — Alex F. R. P. Rada, II
(74) *Attorney, Agent, or Firm* — Marsh Fischmann & Breyfogle LLP; Kent A. Lembke

(57) ABSTRACT

A walk-around character assembly or system with enhanced control functionality to provide a performer of a walk-around character the ability to silently and non-visibly trigger audio, animation, and/or special effects. A deflection monitoring (or chin movement) sensor is provided in the head portion of the character costume to detect predefined chin movements, e.g., a performer opening their mouth once or twice within a time period to limit false negatives/triggers. For example, a potentiometer or force sensor may be provided in the chin strap of a character head. The performer is able to trigger an audio response or to animate the mouth of the character head with relatively small movements of their jaw as a controller processes the sensor signals to determine when to generate control signals to operate sound equipment on the character costume.

19 Claims, 4 Drawing Sheets

(56) References Cited

U.S. PATENT DOCUMENTS

| | | | | |
|---|---|---|---|---|
| 7,632,217 | B2 | 12/2009 | Rooney | |
| 7,810,750 | B2 | 10/2010 | Abreu | |
| 2009/0203286 | A1 | 8/2009 | Murayama | |
| 2010/0098270 | A1 | 4/2010 | Abolfathi et al. | |
| 2010/0144239 | A1* | 6/2010 | Eck et al. | 446/330 |
| 2011/0187640 | A1 | 8/2011 | Jacobsen | |
| 2012/0077549 | A1 | 3/2012 | Gibbons | |
| 2013/0130585 | A1* | 5/2013 | Eck et al. | 446/26 |

OTHER PUBLICATIONS

Killion-2006, "Technology for Future Warfighting" available on line at http://www.dtic.mil/cgi-bin/GetTRDoc? AD=ADA481343.

* cited by examiner

CHIN STRAP SENSOR FOR TRIGGERING CONTROL OF WALK-AROUND CHARACTERS

BACKGROUND

1. Field of the Description

The present invention relates, in general, to walk-around, costumed characters and control over audio output (e.g., a character may sing or talk) and onboard robotics (e.g., the character may move their mouth and blink/move their eyes) on such walk-around characters, and, more particularly, to a control assembly for a walk-around character that is configured to sense an actor's chin and/or mouth movement and to respond by triggering audio playback and/or character animation.

2. Relevant Background

Walk-around or costumed characters are used to entertain and interact with visitors of many facilities including theme or amusement parks. A walk-around character is provided by an operator or performer wearing a costume including a head that covers the performer's face. The costume head is mounted to or supported on a headband that is worn by the performer. In the head and/or costume, equipment including sound equipment and robotics is provided so that a walk-around character can speak with visitors to provide a meetable character that can be animated to move their eyes and mouth while they talk and interact with the visitors.

In many applications, the walk-around character is representing a character from a movie, a video game, a cartoon, or the like. The visitors expect that character to have a particular or a single voice, e.g., the voice used in the movie. As a result, the performer cannot simply use their own voice when they meet and talk with visitors, and, instead, scripted lines typically are recorded for each of the walk-around characters to provide the expected voices. The onboard audio or sound equipment is then controlled or triggered to playback these lines at appropriate times. The character's head may simultaneously be animated by operating robotics to provide mouth movement and eye blinks that are synchronized to the audio playback.

To allow each walk-around character to speak to visitors, there has to be an effective way to trigger the animation and/or audio that cannot be detected by the often nearby visitor. For example, the triggering mechanism should not be audible to the visitor. One implementation is to use a backstage operator who has control over the audio and animation by selectively sending wireless control signals to the costume's sound and robotic systems. However, it is not practical in many cases to provide a backstage operator for each walk-around character. In other implementations, control is provided to the performer within the costume using finger paddles that the performer can operate to lip sync the character mouth to the pre-recorded audio track presently being played back to the visitor. Use of finger paddles, though, is typically visible to the visitors, which can ruin the illusion or desired effect.

There remains a need for effective ways to trigger control over walk-around character equipment such as to trigger an audio playback or to trigger animation of the character's mouth. Preferably, such new ways would not be audible and would not be detectable by an observer of the character. In some cases, it may be useful to continue to use finger paddle controls but to provide an additional triggering device. Further, it may be desirable that the trigger be easy for the performer to initiate or operate while also providing relatively few false triggers as interaction with a walk-around character can be ineffective if the character speaks at improper moments or an incorrect scripted line is triggered.

SUMMARY

The following description provides a walk-around character assembly or system with enhanced control functionality to provide a performer of a walk-around character (e.g., a character from a movie) the ability to silently and non-visibly trigger audio, animation, and/or special effects. The assembly can allow triggering without the use of finger paddles or an additional backstage operator. A deflection monitoring (or chin movement) sensor is provided in the head portion of the character costume to detect predefined chin movements, e.g., a performer opening their mouth once or twice within a time period to limit false negatives/triggers.

For example, a string or cable potentiometer or force sensor may be provided in the chin strap of a character head. The performer is able to trigger an audio response or to animate the mouth of the character head with relatively small movements of their jaw as a controller processes the sensor signals/output to determine when to generate control signals to operate sound equipment on the character costume or to operate robotics to animate the character such as by syncing lip movement with a played audio track causing the character to appear to speak to nearby observers.

More particularly, in one embodiment, a character costume is provided with output devices selectively operable by a performer wearing the character costume. The costume includes a head band configured to support a head structure that is adapted for receiving a performer's head, and the costume also includes a chin strap for engaging a performer's chin and retaining the head band on the performer's head. Additionally, the costume includes a sensor assembly sensing movement of the performer's chin and, when the movement is sensed, outputting a sensor signal for triggering operation of the output devices.

In some embodiments, the sensor assembly includes a signal processor processing the sensor signal and, based on the processing, transmitting a control signal to the output devices to initiate playing of an audio recording. In these and other embodiments, the sensor assembly may include at least one of a force sensor detecting force applied on the chin strap, an infrared detector detecting movement of the performer's chin, and a camera and processor for providing visual recognition of a facial movement by a performer wearing the head band.

In other embodiments, though, the sensor assembly includes an elongate elastic member interconnecting the chin strap and the head band. In these embodiments, the sensor assembly includes a sensor sensing changes in a length of the elastic member and, in response, generating the sensor signal. For example, the sensor may be a spring potentiometer, and the sensor assembly may then include a cable extending from a first end connected to the potentiometer to a second end linked to an end of the elastic member connected to the chin strap. In some more particular examples, the cable is arranged so as to extend parallel to a longitudinal axis of the elastic member, and the chin strap includes a nonelastic strap attached to the end of the elastic member connected the chin strap.

According to another aspect, a method is provided for controlling a walk-around costume including a head band and a chin strap for attaching the head band to a head of a performer. The method includes receiving a sensor signal corresponding to movement of the chin strap and then processing the sensor signal based on a trigger definition stored in memory to identify a trigger event. Further, the method includes, when the trigger event is identified, generating a control signal, and, in response to the control signal, playing an audio file with a sound system provided in the walk-around costume.

In some cases, the trigger event is one of the following: a mouth of a performer being opened a preset amount; the mouth of the performer being opened the preset amount and then closed within a first time period; the mouth of the performer being opened the preset amount at least twice within a second time period; and the mouth of the performer being opened and held open for longer than a third time period. In such cases, the preset amount may be defined based on operation of the sensor signal during movement of the chin strap by the performer (e.g., calibrate control to a particular performer).

In some implementations of the method, the sensor signal is generated by a potentiometer, a force sensor, or an IR detector. In one embodiment, the sensor signal is generated by a potentiometer measuring deflection of a flexible member connecting the chin strap to the head band. In these and other embodiments, the sensor signal may be transmitted wirelessly to a controller that performs the processing of the sensor signal, and the control signal may be transmitted wirelessly to the sound system to initiate the playing of the audio file.

DETAILED DESCRIPTION

Figure 1:
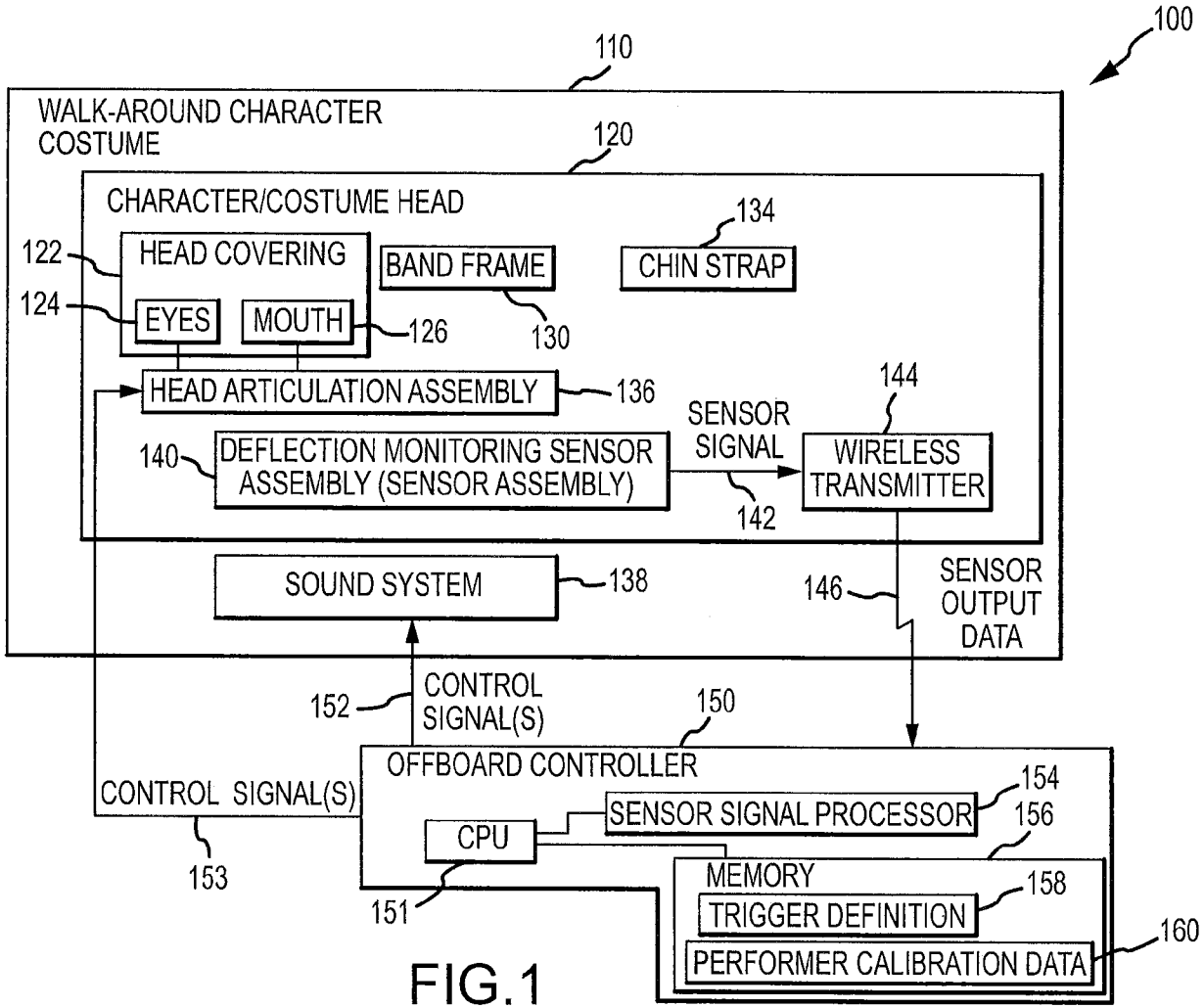
FIG. 1 is a functional block drawing of a walk-around character system or assembly showing use of a chin movement sensor to facilitate control of audio playback and/or animation of costume components such as lip and eye movements.

Briefly, the present description is directed toward mechanisms for allowing a wearer ("performer") of a character costume to be able to trigger costume output such as audio playback or animation of the character's eyes, mouth, ears, and the like with onboard robotics. Such performer control may be provided with a sensor assembly provided in the character head (or costume head unit) that is adapted to sense or monitor movement of the performer's jaw, e.g., opening their mouth a predefined amount and, in response, to transmit a signal to an onboard or offboard sensor signal processor to determine when control signals should be triggered and transmitted to the sound or animation components of the costume.

In one exemplary implementation, the performer wears a head band with a chin strap, and the head band is attached to the costume head covering/enclosure (e.g., the portion of the head that observer's see along with a frame/structure for supporting robotics to move, for example, the eyes, lips, and/or other facial features and, in some cases, sound equipment such that audio playback is output near the character's mouth). A sensor assembly is provided to determine, via the chin strap, when the performer moves their jaw in a predefined manner such as movements associated with two full or partial openings of their mouth within a short time period. The sensor assembly in one case includes a flexible member (e.g., elastic strap or band) that is attached at one end to the chin strap and at the opposite end to the head band, with the chin strap being relatively fixed in length or non-elastic (e.g., a leather strap with a chin-receiving element with little or no give and with "non-elastic" generally meaning less elasticity than the flexible member/band such that this member is stretched in response to jaw movement).

The sensor assembly also includes a string/cable potentiometer mounted on the head band, with its string or cable extending from the potentiometer/head band-mounting location to the end of the flexible member (e.g., connected at an attachment point that coincides with the link/connection between the flexible member and the non-elastic chin strap). In this way, the potentiometer cable runs parallel to the elongated flexible member and has similar or matching attachment points. In one particular embodiment, the end of the potentiometer cable is attached to the snap where the flexible strap connects to the rigid chin strap.

When the performer moves their jaw, the cable/string moves as the flexible strap is stretched from its original length (when the performer's jaw is in a first position that may correspond with their mouth being closed to open a small amount) to a new or second length. A controller/computer (or other device to play audio or control animation with) is communicatively connected to the potentiometer and reads the change and, in response, may trigger an audio clip or animation of the character head. With this overview in mind, it may now be useful to discuss these control concepts in more detail with reference to FIGS. 1-3, which provide system implementations and then proceed to discuss one particular implementation of such a chin strap sensor for triggering control of walk-around characters.

FIG. 1 provides a functional block diagram of a walk-around character system or assembly 100 that includes a walk-around character costume 110. The costume 110 may be used to represent a character from a movie or otherwise used to entertain visitors of a facility such as a theme park. The costume 110 is adapted to playback audio tracks, such as scripted lines of the voice of the character, and also to be articulated or animated, such as to have a moving mouth and blinking/moving eyes with such animation synchronized with the playing audio. To this end, the costume 110 is shown to include a character/costume head 120, a sound system 138 (which may be partially or wholly positioned inside the head 120 in some embodiments), and an offboard controller/computer system 150.

The costume head 120 includes an outer frame or head covering (or head unit) 122 supporting eyes 124 and a mouth 126 that can be animated/articulated with a head articulation assembly 136 (e.g., robotic mechanisms). The costume head 120 may also be considered to include a head band (or frame) 130 and a chin strap 134 connected to the head band 130. The head band 130 is adapted to support the head unit 122 and is worn by a performer when the costume 110 is in use, and the chin strap 134 is configured to engage/receive the performer's chin and secure the headband 130 and supported head unit 122 to the performer's head.

Significantly, a deflection monitoring sensor assembly (or chin movement sensor assembly) 140 is also provided in the costume head 120. The sensor assembly 140 is adapted to sense or monitor movement of a performer's jaw (or chin)

while they are wearing the head band 130 with the chin strap 134. A wide variety of sensors may be used in the assembly 140 that operate to respond to chin movement to output a sensor signal 142. A wireless transmitter 144 is included that is programmed or configured to transmit a wireless signal 146 to provide sensor output data to the offboard controller 150 for processing.

The sensor, for example, may be a force sensor measuring the force or amount of pull on the chin strap, which can be correlated by the controller 150 to movement of the performer's jaw such as when they open their mouth. The sensor may be a distance sensor in other embodiments. The assembly 140 may use a material that changes conductivity with stretching (e.g., resistance varies with stretching), and this material may be provided in the chin strap 134 or between the chin strap 134 and the head band 130. The assembly 140 may include a camera placed inside the head covering 122 and focused on a portion of the performer's face, e.g., their mouth, and its output may be processed by the signal processor 154 to provide visual recognition of a triggering event/facial movement in trigger definition 158. In another case, an infrared (IR) detector is used in the assembly 140 such as to monitor a distance from a chin (or other portion of the face/jaw) to another place on the costume to allow monitoring by processor 154 of movement. In yet another case, the sensor assembly 140 includes a set of electrodes attached (or attachable) to the performer's face to measure muscle movements, and the processor 154 is used to determine what muscles have moved and to what magnitude and to determine if these muscle movements match a trigger definition 158.

In one prototype (see FIG. 3), the sensor assembly 140 includes a cable/string potentiometer and a flexible band attaching a nonelastic portion of the chin strap 134 to the head band 130. The cable is coupled with an end of the flexible band such that the cable moves when the band is stretched, and the cable movement is sensed/measured by the potentiometer, which, in turn, acts to output a sensor signal 142 for relaying/transmission as output data 146 by the wireless transmitter 144.

In this system 100, an offboard controller 150 is provided within the range of the wireless transmitter 144 to receive the sensor output data signal 146 and to determine whether or not to generate/issue control signals 152, 153 to the sound system 138 (to cause a particular audio track to be played) and/or to the head articulation assembly 136 (to cause the eyes 124 and/or mouth 126 to move in a defined manner). The offboard controller 150, therefore, would include a wireless transceiver (not shown) and may include one or more processors 151. The CPU 151 is shown to run/manage a sensor signal processor 154 and memory/data storage 156. The signal processor 154 may be hardware and/or software configured to process the sensor output data 146 to determine whether or not an audio or animation trigger was provided by the performer wearing the head 120 by moving their jaw.

For example, it may be desirable to allow a performer to trigger a control signal 152, 153 by a predefined jaw movement. This may involve a vertical opening and closing of the mouth to a predefined extent, which has a corresponding amount of jaw movement (generally linear) that may be calibrated to the particular performer wearing the costume head as jaw movements for differing people will cause differing amounts of linear movement (e.g., for the chin strap 134). With this in mind, the memory 156 may be used to store a trigger definition 158 and also performer calibration data 160.

For example, if the sensor assembly 140 uses a force sensor to monitor jaw movement, the trigger definition 158 may define a force threshold that triggers generation of a control signal 152, 153, with the calibration data 160 modifying such a definition (or being used in its generation) such as to require less force for some performers than others to limit false negatives (as too light of a trigger response may result in producing too many control signals 152, 153 while too heavy of a trigger response may result in performer fatigue or other issues such as some performers having difficulty "pulling the trigger"). If a potentiometer is used, the trigger definition 158 may include an amount of linear movement of the potentiometer string/cable and the associated flexible or stretchable (or elastic) band/member attached to the chin strap.

The trigger definition 158 may vary to practice the system 100, but it may be adapted to limit false negatives and provide more accurate trigger control with chin/jaw movement. For example, a first definition 158 may call for triggering when the jaw is sensed to move once more than a predefined amount (which may vary for each performer based on calibration data 160). This may involve the performer opening their mouth to a full or nearly full position one time (vertically open and closed or trigger on opening alone). It was appreciated by the inventor, though, that a single jaw movement taken alone may result in false trigger events such as when the performer simply smiles or yawns.

With this in mind, a second trigger definition 158 may call for two jaw movements to be sensed within a particular trigger time period or window (e.g., 1 to 3 seconds or the like). In this case, the performer would have to move their jaw more than a predefined amount twice within the time window, the signal processor 154 would compare this data 146 with the definition 158, and, when appropriate, initiate one or both control signals 152, 153 to cause eye movement, mouth movement, and/or an audio playback. Other trigger definitions 158 may call for the performer to hold their mouth open for longer than a threshold time (e.g., more than 4 to 6 seconds or the like). However, to avoid smiles or yawns being determined to be such triggers, it may instead be useful for the trigger definition 158 to be a very quick mouth opening so open and close within a short window (such as less than 0.5 to 1 seconds or the like).

The sensor output data 146 may be processed by the signal processor 154 against the trigger definition 158 (and, optionally, calibration data 160) to determine when a trigger event has occurred with regard to the performer's chin/jaw. This trigger may be used to initiate control signals 153 by the controller 150 to cause the head articulation assembly 136 to animate/move the eyes 124 and/or mouth 126 (or other head components, not shown). In other cases, though, the trigger from the jaw is used to initiate control signals 152 used to cause the sound system 138 to playback or output a particular sound (e.g., a recorded scripted line for the voice associated with the character represented by the costume 110). Concurrently or in synchronized fashion, the controller 150 may also send control signals 153 to the articulation assembly 136 to cause the character to lip sync the selected audio track/scripted lines and/or to have facial expression/animation matching the triggered 152 output of the sound system 138.

Figure 2:
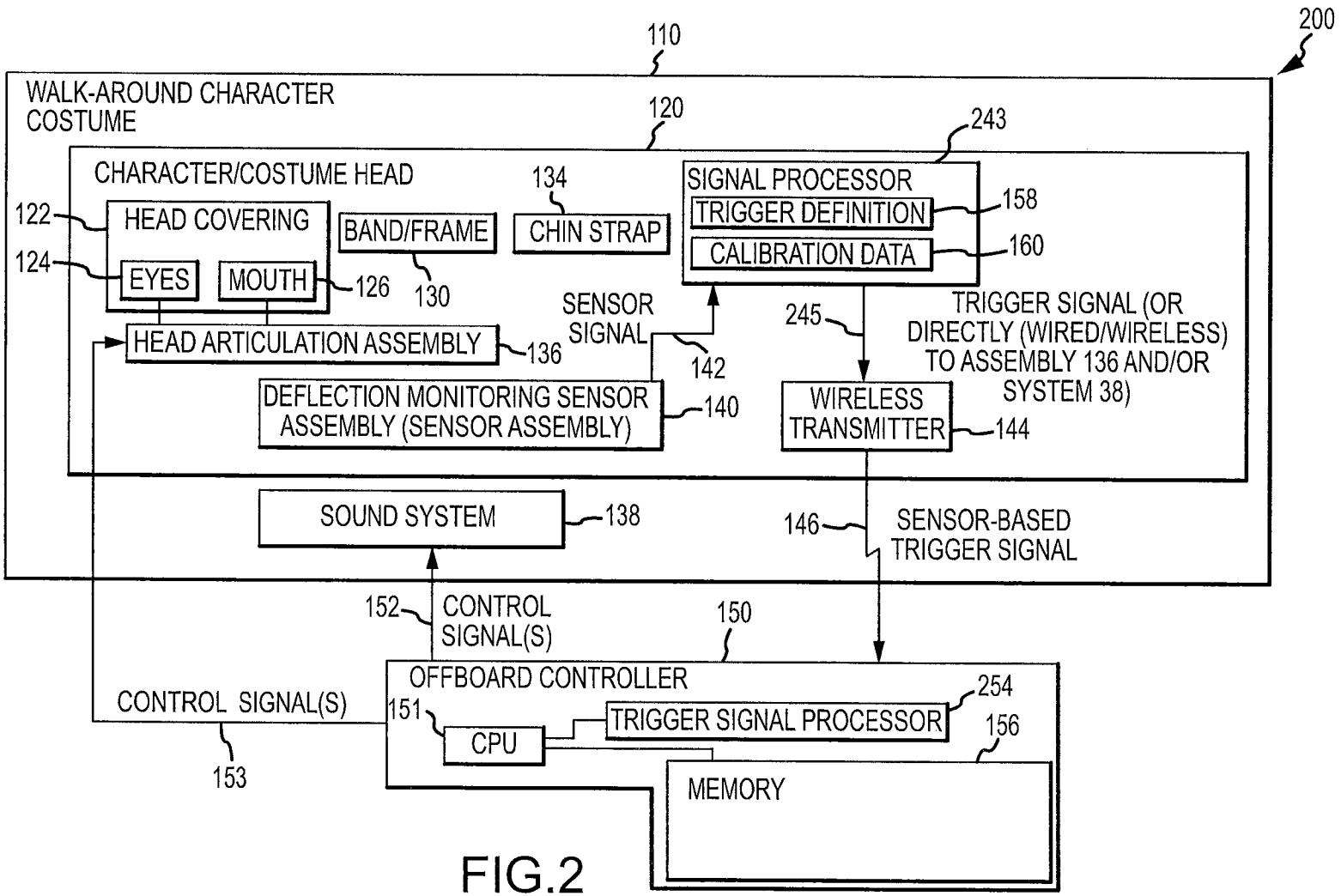
FIG. 2 illustrates a functional block drawing similar to FIG. 1 showing an embodiment in which sensor output is fully or at least partially processed with an onboard processor/controller to reduce or even eliminate wireless transmissions.

In some embodiments, it may be desirable to reduce the amount of wireless transmissions required to operate a walk-around character. FIG. 2 illustrates another system 200 that is a modified version of system 100 with this goal in mind, and components used in both systems 100 and 200 are labeled with like reference numbers.

As shown, a signal processor 243 is provided on the costume 110 (e.g., as part of the assembly 140) to receive output signals 142 from the sensor. The signal processor 243 acts to process the sensor output 142 based on the trigger definition 158 and, optionally, the performer-specific calibration data 160 (as discussed above) to determine when it is appropriate to trigger an audio playback, animation of the costume 110, or other costume-based effect/output.

When a trigger event is identified, a trigger signal 245 may be sent to the wireless transmitter 144 for wireless transmission as sensor-based trigger signal 146 to the offboard controller 150. The trigger signal processor 254 acts to select a proper costume output for the trigger signal 245, and, in response, to send the control signals 152, 153. Alternatively, the signal processor 243 may be a more complex controller/computer that acts to send the trigger signal 245 directly in a wired or wireless manner to the sound system 138 to cause a particular audio output and/or to the head articulation assembly 136 to animate the eyes 124 and/or mouth 126 (or other costume components).

Figure 3:
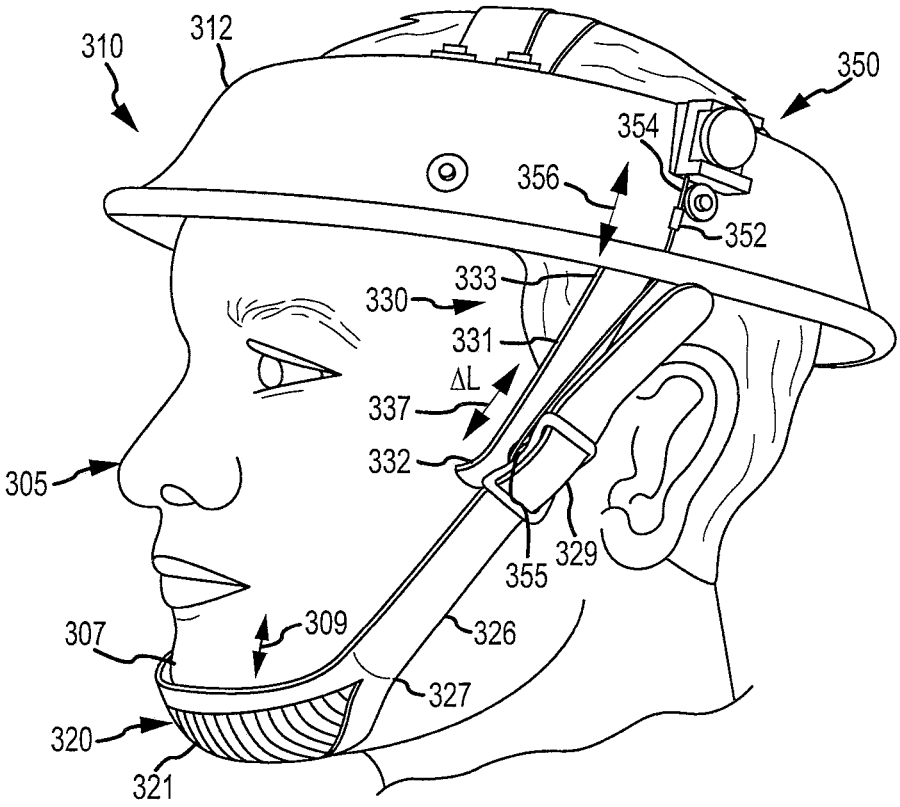
FIG. 3 is a side perspective view of a portion of a costume head, being worn by a performer, with the outer covering and components removed to show a sensor assembly of one embodiment making use of a spring potentiometer to sense or monitor movement of the performer's chin via movement of a chin strap to trigger animation and audio playback.

At this point, it may be useful to discuss one particular (but not limiting) example of how a chin strap-based sensor assembly may be implemented for use in a walk-around character. FIG. 3 illustrates a costume head 310 such as may be used for head 120 in systems 100, 200 and worn by a performer whose head 305 is shown, with the outer head covering/structure (such as covering 122) removed to show relevant features for sensing/monitoring movement 309 of the performer's chin 307.

The costume head 310 includes a head band 312 that is adapted to be worn on the performer's head 305 and to receive and support a head covering/head unit (not shown). To hold or retain the head band in place, a chin strap 320 is provided with a chin-receiving element or cup 321 in which the performer's chin 307 is inserted when in use. The chin strap 320 further includes one or two elongated, nonelastic (i.e., less elastic than band 331) bands or straps 326 (e.g., leather straps) extending from a first end 327 connected to chin-receiving element 321 to a second end 329.

The costume head 310 includes a sensor assembly 330 to allow the movement 309 of the chin 307 to be sensed/monitored. The sensor assembly 330 includes an elongated flexible band 331 (e.g., a flat band or body of a material that is elastic to stretch or be deformed with chin movement 309 but also to return to its original shape). The flexible band 331 engages the second end 329 of the chin strap band 326 with a first end 332, and a second end 333 of the band 331 is affixed to the head band 312. These connections may be such that the longitudinal axes of the bands/straps 326, 331 are parallel (or nearly co-linear). In this way, stretching 337 of the flexible/elastic band 331 in response to chin movement 309 generally corresponds to linear movement (change in band length, $\Delta L$) of the jaw 307. The band 331 may be formed of nearly any elastic material and may even take the form of a rubber band, a spring, or the like. The original or at-rest length may also vary to practice the sensor assembly 330, and the length and amount of stretch 337 in response to jaw movement 309 is typically selected to suit the potentiometer 350 to allow ready detection and relatively easy triggering 309 by the performer.

To monitor movement/stretching 337 or changes in band length, $\Delta L$, the sensor assembly 330 includes a string/cable potentiometer 350. The potentiometer 350 is attached to the head band 312. A string/cable 352 is provided that is attached at a first end 354 to the potentiometer 350 (e.g., a spring (not shown) inside the potentiometer 350) such as at an attachment point that is adjacent the attachment point of end 333 of flexible band 331 to head band 312 (although this is not required). The cable 352 is attached at a second end/attachment point 355 to the flexible band end 332 (or to the snap/coupling mechanism used to join the band ends 332, 329 together). The cable 352 is arranged to extend along the band 331 so as to be generally parallel such that when the band 331 moves (or attachment point 329 moves) the cable 352 also moves as shown with arrow 356.

The potentiometer 350 operates in response to such movements 356 to transmit a sensor output signal in a wired or wireless manner to a controller (e.g., via a wireless transmitter 144 as shown for systems 100, 200) for processing and, when appropriate, for triggering control signals used to operate a sound system or robotics. The movements 337, 356 may not be identical, and calibration processes may be used to allow the controller to properly process the output signals from potentiometer 350 to determine when a trigger event has occurred (e.g., when movements 309 of chin 307 or the performer's jaw exceeds a threshold in a predefined manner such as twice within a window or once very quickly (within a different, shorter window)).

Figure 4:
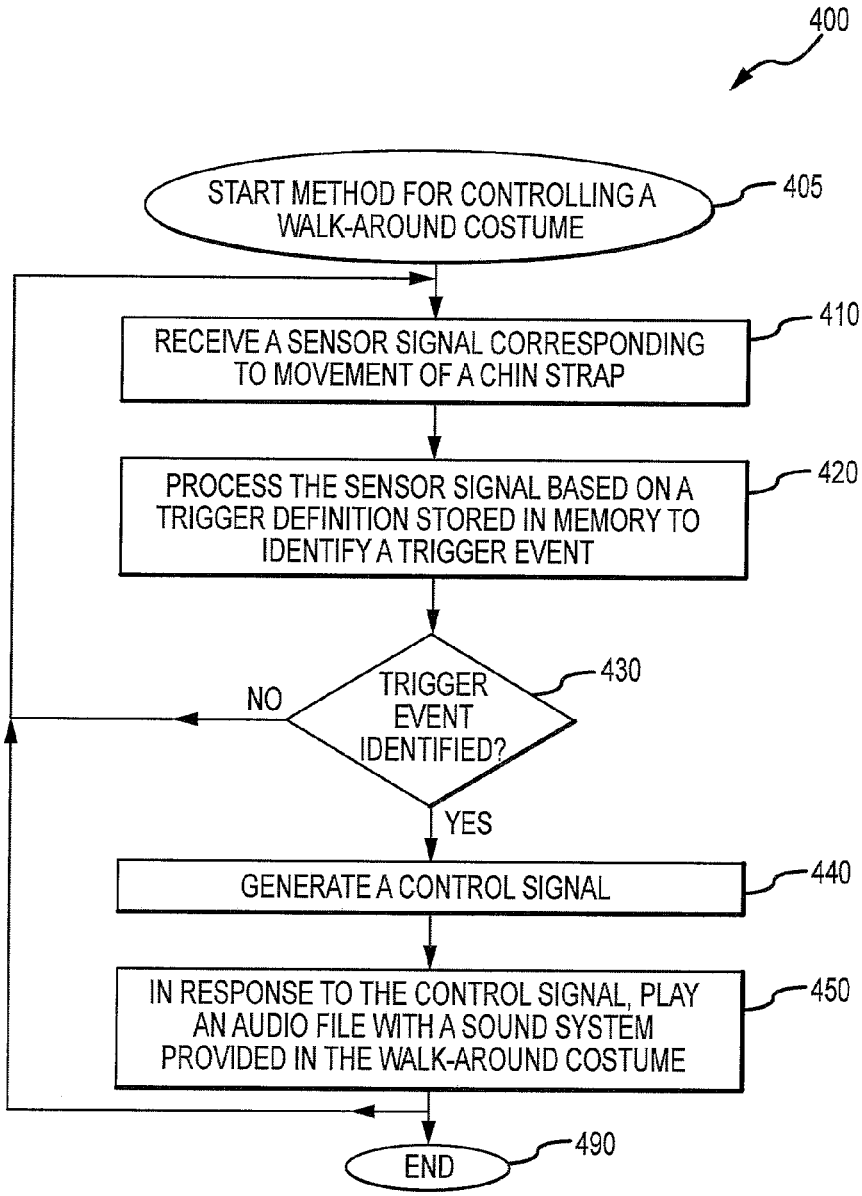
FIG. 4 is a flow diagram of a method of controlling a walk-around costume.

FIG. 4 is a flow diagram of a method 400 of controlling a walk-around costume, which includes a head band and a chin strap for attaching the head band to a head of a performer. The method 400 starts at 405 and includes, at 410, receiving a sensor signal corresponding to movement of the chin strap. At 420, the method 400 includes processing the sensor signal based on a trigger definition stored in memory to identify a trigger event. At 430, the method 400 includes determining whether a trigger event has been identified, and, if not, the method continues at 410. However, when a trigger event is identified as determined at 430, the method 400 continues at 440 with generating a control signal. The method 400 further includes at 450, in response to the control signal, playing an audio file with a sound system provided in the walk-around costume. The method 400 may end at 490 or continue with repeating step 410.

In some implementations of the method 400, the trigger event is selected from the following group: a mouth of a performer being opened a preset amount; the mouth of the performer being opened the preset amount and then closed within a first time period; the mouth of the performer being opened the preset amount at least twice within a second time period; and the mouth of the performer being opened and held open for longer than a third time period. In some cases, the preset amount is defined based on operation of the sensor signal during movement of the chin strap by the performer. In the method 400, the sensor signal is generated by a potentiometer, a force sensor, or an IR detector. Also, in implementing the method 400, the sensor signal can be generated by a potentiometer measuring deflection of a flexible member connecting the chin strap to the head band. Further, in performing the method 400, the sensor signal can be transmitted wirelessly to a controller that performs the processing of the sensor signal. The control signal may also be transmitted wirelessly to the sound system to initiate the playing of the audio file.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the system 200 of FIG. 2 may be further modified to include the controller 150 within the costume 110 or to provide an onboard controller. In this configuration, everything is self-contained in the costume, and communications 146, 152, 153 may be wired communications (or still wireless if desired in certain applications). In this manner and with reference to FIGS. 1 and 2 and this additional embodiment, there is no restriction on the location of the controller 150 or of the signal processor 154, 243 or of data storage/memory storing information used in the processing of sensor signals or in the generation of control signals 152, 153.

I claim:

1. A character costume with output devices selectively operable by a performer wearing the character costume, comprising:

a head band configured to support a head structure that is adapted for receiving a performer's head;

a chin strap for engaging a performer's chin and retaining the head band on the performer's head; and a sensor assembly sensing movement of the performer's chin and, when the movement is sensed, outputting a sensor signal for triggering operation of the output devices, wherein the sensor assembly includes at least one of a force sensor detecting force applied on the chin strap, an infrared detector detecting movement of the performer's chin, and a camera and processor for providing visual recognition of a facial movement by a performer wearing the head band.

2. The character costume of claim 1, wherein the sensor assembly includes a signal processor processing the sensor signal and, based on the processing, transmitting a control signal to the output devices to initiate playing of an audio recording.

3. A character costume with output devices selectively operable by a performer wearing the character costume, comprising:

a head band configured to support a head structure that is adapted for receiving a performer's head;

a chin strap for engaging a performer's chin and retaining the head band on the performer's head; and a sensor assembly sensing movement of the performer's chin and, when the movement is sensed, outputting a sensor signal for triggering operation of the output devices, wherein the sensor assembly includes an elongate elastic member interconnecting the chin strap and the head band and wherein the sensor assembly includes a sensor sensing changes in a length of the elastic member and, in response, generating the sensor signal.

4. The character costume of claim 3, wherein the sensor comprises a spring potentiometer.

5. The character costume of claim 4, wherein the sensor assembly includes a cable extending from a first end connected to the potentiometer to a second end linked to an end of the elastic member connected to the chin strap.

6. The character costume of claim 5, wherein the cable extends parallel to a longitudinal axis of the elastic member and wherein the chin strap comprises a nonelastic strap attached to the end of the elastic member connected the chin strap.

7. A walk-around costume system, comprising:

a sound assembly;

a costume head including a head band, a chin strap, and a deflection monitoring assembly monitoring movement of a jaw of a person wearing the costume head and, in response, outputting a sensor signal; and a controller processing the sensor signal and, based on the processing, generating a control signal to the sound assembly to trigger playing an audio track.

8. The system of claim 7, wherein the processing of the sensor signal includes comparing the movement of the jaw to a trigger definition, the trigger definition comprising one of the following: single movement of the jaw greater than a threshold amount, two or more movements of the jaw that are greater than the threshold amount within a trigger time period, movement of the jaw greater than the threshold amount that is sustained longer than a trigger minimum time period, and a single movement of the jaw greater than the threshold amount within a trigger maximum time period.

9. The system of claim 7, wherein the processing of the sensor signal includes comparing the movement of the jaw to a trigger definition, the trigger definition being calibrated to the person wearing the costume head.

10. The system of claim 7, wherein the generating of the control signal is performed when the processing determines, based on the movement of the jaw, the performer has opened their mouth at least a predefined amount at least one time.

11. The system of claim 7, wherein the deflection monitoring assembly includes an elastic band connecting the chin strap to the head band and further includes a sensor providing the sensor signal based on an amount of deflection of the elastic band.

12. The system of claim 11, wherein the sensor comprises a potentiometer and the deflection monitoring assembly includes a cable connected at one end to the potentiometer and at a second end to the elastic band, whereby the cable is pulled away from the potentiometer when the elastic band is stretched.

13. The system of claim 12, wherein the potentiometer is mounted to the head band and the cable extends parallel to a longitudinal axis of the elastic band.

14. A method for controlling a walk-around costume including a head band and a chin strap for attaching the head band to a head of a performer, comprising:

receiving a sensor signal corresponding to movement of the chin strap;

processing the sensor signal based on a trigger definition stored in memory to identify a trigger event;

when the trigger event is identified, generating a control signal; and in response to the control signal, playing an audio file with a sound system provided in the walk-around costume.

15. The method of claim 14, wherein the trigger event is selected from the group consisting of: a mouth of a performer being opened a preset amount; the mouth of the performer being opened the preset amount and then closed within a first time period; the mouth of the performer being opened the preset amount at least twice within a second time period; and the mouth of the performer being opened and held open for longer than a third time period.

16. The method of claim 15, wherein the preset amount is defined based on operation of the sensor signal during movement of the chin strap by the performer.

17. The method of claim 14, wherein the sensor signal is generated by a potentiometer, a force sensor, or an IR detector.

18. The method of claim 14, wherein the sensor signal is generated by a potentiometer measuring deflection of a flexible member connecting the chin strap to the head band.

19. The method of claim 14, wherein the sensor signal is transmitted wirelessly to a controller that performs the processing of the sensor signal and wherein the control signal is transmitted wirelessly to the sound system to initiate the playing of the audio file.

* * * * *